US006551046B1

(12) United States Patent
Dorrington

(10) Patent No.: US 6,551,046 B1
(45) Date of Patent: Apr. 22, 2003

(54) LIFTING AND TIPPING DEVICE

(75) Inventor: Gerald Dorrington, Woodstock (ZA)

(73) Assignee: Zoller Holding GmbH, Mainz (DE)

( * ) Notice: Subject to any disclaimer, the term of this patent is extended or adjusted under 35 U.S.C. 154(b) by 0 days.

(21) Appl. No.: 09/674,954

(22) PCT Filed: May 6, 1999

(86) PCT No.: PCT/EP99/03118

§ 371 (c)(1),
(2), (4) Date: Jan. 23, 2001

(87) PCT Pub. No.: WO99/58431

PCT Pub. Date: Nov. 18, 1999

(30) Foreign Application Priority Data

May 11, 1998 (ZA) ..... 98/3946

(51) Int. Cl.[7] ..... B65F 3/04; B65F 3/08

(52) U.S. Cl. ..... 414/408; 414/409; 414/421

(58) Field of Search ..... 414/406, 408, 414/409, 420, 421, 645, 646, 647, 648

(56) References Cited

U.S. PATENT DOCUMENTS

| | | | | |
|---|---|---|---|---|
| 2,592,085 A | * | 4/1952 | Van Doorne | 414/406 |
| 2,592,324 A | * | 4/1952 | Oliver | |
| 4,305,693 A | * | 12/1981 | Naab | 414/411 |
| 4,365,922 A | * | 12/1982 | Borders | 414/406 |
| 4,978,268 A | * | 12/1990 | Winwood et al. | 414/409 |
| 4,978,269 A | * | 12/1990 | Niederer | 414/421 |
| 5,002,450 A | * | 3/1991 | Naab et al. | 414/408 |

FOREIGN PATENT DOCUMENTS

| | | | |
|---|---|---|---|
| DE | 1 126 310 | | 3/1962 |
| DE | 1 282 547 | | 5/1966 |
| DE | 44 08 723 | | 9/1994 |
| EP | 339360 | * | 4/1989 |
| EP | 379060 | * | 1/1990 |
| EP | 358 046 | | 3/1990 |
| GB | 1 339 454 | | 7/1975 |

* cited by examiner

*Primary Examiner*—James W. Keenan
(74) *Attorney, Agent, or Firm*—Hudak, Shunk & Farine, Co. LPA

(57) ABSTRACT

The invention relates to a lifting and tipping device for emptying containers into the loading opening of a collecting container, especially for emptying refuse containers (50) into the collecting container (12) of a refuse truck (10). The lifting and tipping device (5) has a swivel drive device (32) in the area of the loading opening (14) to which at least one swivel arm (38) with a device (46) for receiving a container is connected with a non-positive fit. The aim of the invention is to provide a lifting and tipping device **(5*a*, 5*b*) which is as compact as possible and in which the device (46) for receiving a container moves substantially from the bottom upwards without a significant horizontal component when it take hold of the refuse container (50). To this end the invention provides for the swivel drive device (32) to be fixed to a slide (60) guided in at least one vertical rail (16), and for at least a support lever and connecting rod which transform the rotation of the swivel drive device (32), during a simultaneous swivel movement of the swivel arm (38), into a lifting movement of the slide (60) which stops at a defined height of lift. The slide (60) can be locked in relation to the rail (16)** at the defined height of lift.

11 Claims, 9 Drawing Sheets

LIFTING AND TIPPING DEVICE

FIELD OF THE INVENTION

The invention relates to a lifting and tipping device for emptying containers into the loading opening of a collecting container, particularly for emptying refuse containers into the collecting container of a refuse truck, with a swivel drive device arranged in the area of the loading opening, to which at least one swivel arm with a device for receiving a container is connected with a non-positive fit.

BACKGROUND OF THE INVENTION

Such a lifting and tipping device is known from EP 0 358 046 B1. The swivel arm forms part of an articulated quadrangle comprising a lifting and tipping frame, the swivel arm, a lower guide rod and a support arm. The driving mechanism for the lifting and tipping device is a swivel drive device with a coaxial upper and lower cylinder piston arrangement and a rack-and-pinion gear with drive shaft actuated by the two cylinder piston arrangements therebetween. The swivel arm is attached to the drive shaft in a non-positive fit. The support arm is mounted so as to be freely rotatable on the drive shaft and is thus coaxial thereto. The swivel arm device and the articulated quadrangle form a closed unit mounted in the area of the loading opening.

When the swivel drive device is actuated, the swivel arm is swung upward causing the articulated quadrangle to open up into a rectangle. To fix the opened articulated quadrangle, an additional limit device is provided. The opening of the articulated quadrangle is combined with a wide swivel movement of the container receiving device. As a consequence, under some circumstances, the container to be picked up may be pushed away considerably from the lifting and tipping device before the rim of the container is grasped from underneath. This problem occurs especially if the container is particularly high. On sloping terrain the refuse container may, under some circumstances, roll away. Since the swivel drive device is fixed on the collecting container and itself does not execute a lifting movement, the entire lifting and swivel movement for tipping the refuse container into the opening is executed by the articulated quadrangle, which requires correspondingly long swivel arms.

SUMMARY OF THE INVENTION

It is the object of the invention to create a more compact lifting and tipping device in which the container receiving device, as it grasps the refuse container, moves essentially from bottom to top without an appreciable horizontal component.

This object is attained by a lifting and tipping device in which the swivel drive device is fixed to a slide that is guided in a substantially vertical rail. Means are provided to transform the rotation of the swivel drive device, during a simultaneous swivel movement of the swivel arm, into a lifting movement of the slide, which stops at a defined height of lift. The slide can be locked in relation to the rail at the defined height of lift.

The lifting and tipping device according to the invention can be mounted either on the side of the refuse truck (side loader) or at the rear (rear loader). Furthermore, the lifting and tipping device can be a single device, or two lifting and tipping devices can be arranged side by side and mounted on a common slide, or each on its own slide, so that they can be actuated independently of one another. The slide or slides may also be guided in two lateral rails, which increases the stability of the entire device.

The advantage of the lifting and tipping device is that the swivel drive device is automatically raised when actuated. As a result, the swivel arm and thus also the container receiving device execute a combined lifting and swiveling movement, so that the swivel arm can be extremely short. Due to the short swivel arm, the container receiving device is only a few centimeters away from the swivel drive device. This lifting and tipping device makes it possible securely to grasp containers of various heights, without the container being pushed away from the lifting and tipping device by the swivel movement of the container receiving device.

After the refuse container has been grasped and a defined height of lift is reached, the lifting movement is terminated by locking the slide in relation to the rail and only the swiveling movement of the swivel drive device continues to tip the refuse container into the loading opening. The movement of the swivel drive device need not be interrupted. This ensures a continuous process without any delays.

After emptying, the swivel drive device is put in reverse. When it reaches a defined swivel position, the lock is canceled, so that a lowering motion is added to the swivel motion until the container reaches the ground and the container receiving device detaches from the container rim or a defined end position is reached.

According to a preferred embodiment, the means for transforming the rotation of the swivel drive device, during a simultaneous swivel movement of the swivel arm, into a lifting movement of the slide which stops at a defined height of lift, may comprise a support lever and a connecting rod. The connecting rod on the one hand is coupled eccentrically to the swivel drive device and on the other hand to the support lever, which in turn is coupled to the slide and directly or indirectly to the collecting container.

The connecting rod is preferably arranged on the swivel drive device in such a way that it moves downward in relation to the swivel drive device as the container receiving device is swiveled.

The eccentric arrangement of the connecting rod is preferably selected so that in the lowered position, the coupling point of the connecting rod on the swivel drive device is approximately at the same height as the swivel axis of the swivel drive device. This coupling point is located between the swivel drive device and the collecting container to create a compact arrangement.

When the swivel drive device is actuated, this coupling point moves downward so as to press the connecting rod downward. Since the connecting rod is simultaneously supported against the support lever, the swivel drive device is lifted because the slide is shifted along the rail.

The support lever is preferably an angle lever extending underneath the slide in the direction of the collecting container where it is directly or indirectly coupled to a stationary component.

The angle lever is preferably connected with the collecting container via a link element to permit limited horizontal mobility.

Advantageously, the rotary axes passing through the coupling points of support lever and connecting rod are arranged parallel to the swivel axis of the swivel drive device.

The support lever is furthermore advantageously coupled to a holding element fixed to the slide and extending underneath the swivel drive device from the slide up to in front of the swivel drive device. This simultaneously creates a connection between angle lever and slide so that the lifting movement can be executed in conjunction with the connecting rod. The connecting rod is arranged adjacent to the coupling point of the angle lever on the holding element. The two coupling points are located at the free end of an arm of the angle lever.

The coupling point of the connecting rod on the angle lever is preferably located between the coupling point of the angle lever with the holding element and the slide. With the movement of the connecting rod, a simultaneous tipping movement of the angle lever is executed, which supports the lifting movement of the slide.

To limit the lifting movement, a locking mechanism that can be actuated by the connecting rod upon reaching a defined height of lift is arranged on the slide. This locking mechanism is preferably actuated when the coupling point of the connecting rod is approximately below the swivel axis of the swivel drive device. The locking mechanism preferably has a spring-loaded bolt that engages with an opening of a locking plate arranged on the rail at the predefined height of lift.

Since, as the swivel movement of the swivel drive device continues, the connecting rod also moves, while a further lifting movement is at the same time prevented by the lock, the connecting rod is extended. Thus, the connecting rod is preferably telescopic.

An exemplary embodiment of the invention will now be explained in greater detail with reference to the drawings in which:

DETAILED DESCRIPTION OF THE INVENTION

Figure 1:
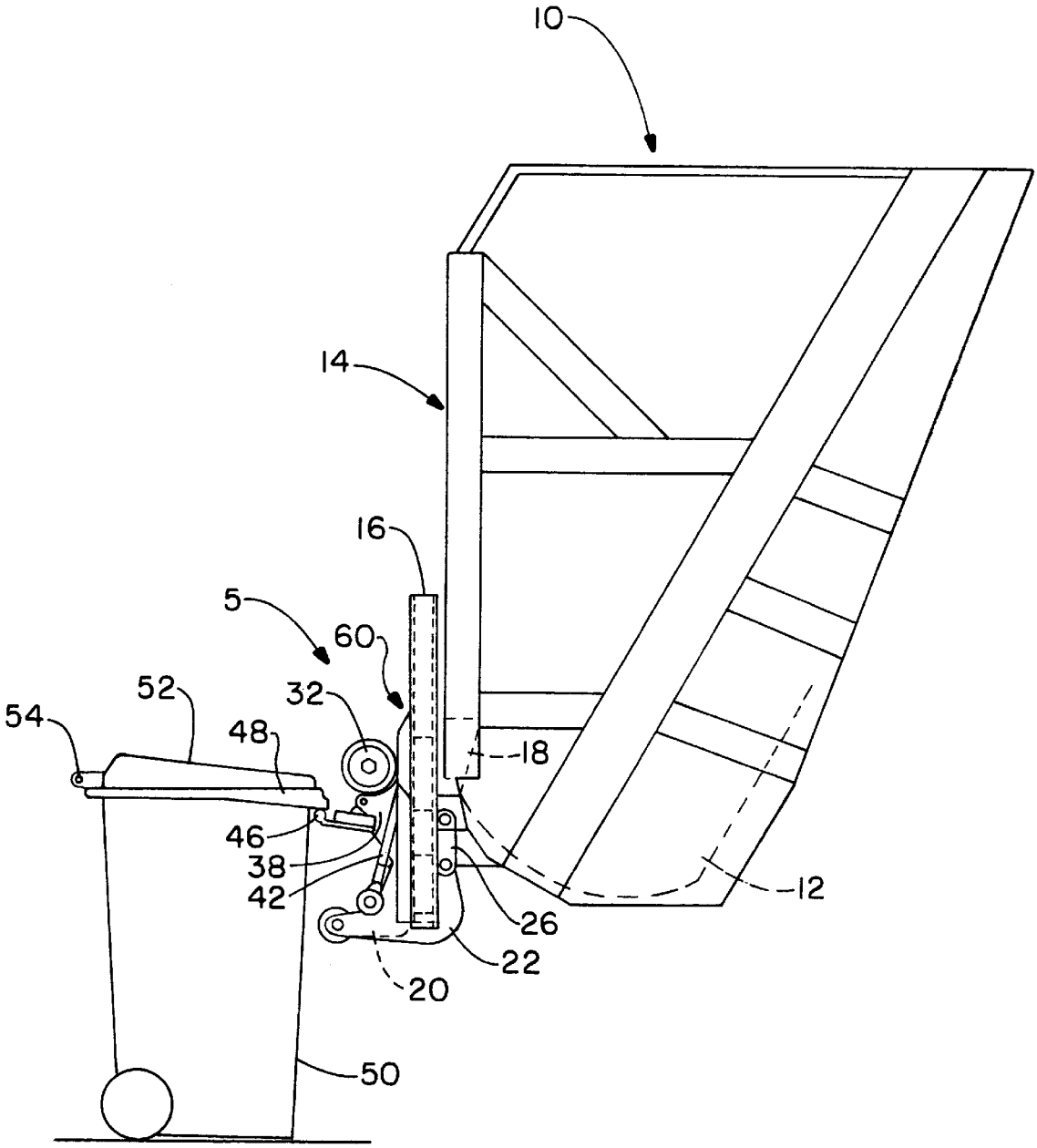
FIG. 1 is a side view of the lifting and tipping device prior to picking up the refuse container.

FIG. 1 depicts the rear of a refuse truck 10 with a collecting container 12 on which a lifting and tipping device 5 is arranged in the area of the loading opening (14). The lifting and tipping device 5 has a swivel drive device 32 on which a swivel arm 38 with a container receiving device 46 in the form of a receiving ridge is arranged. The lifting and tipping device 5 has a slide 60, which is guided in two vertical rails 16 arranged on either side adjacent to the loading opening 14. Further components of the lifting and tipping device 5 are the holding element 20 fixed to the slide, the support lever 22 and the connecting rod 42. The support lever 22 is connected via a link element 26 with a cross strut 18, which is fixed to the collecting container 12. The details of the lifting and tipping device 5 will be explained in connection with FIGS. 3–9.

FIG. 1 depicts the lifting and tipping device 5 in its lowered position. This figure also shows a refuse container 50 to be emptied, with a receiving rim 48, which the container receiving device 46 grasps from underneath. The container 50 has a lid 52 that can be swung about axis 54 to open it.

Figure 2:
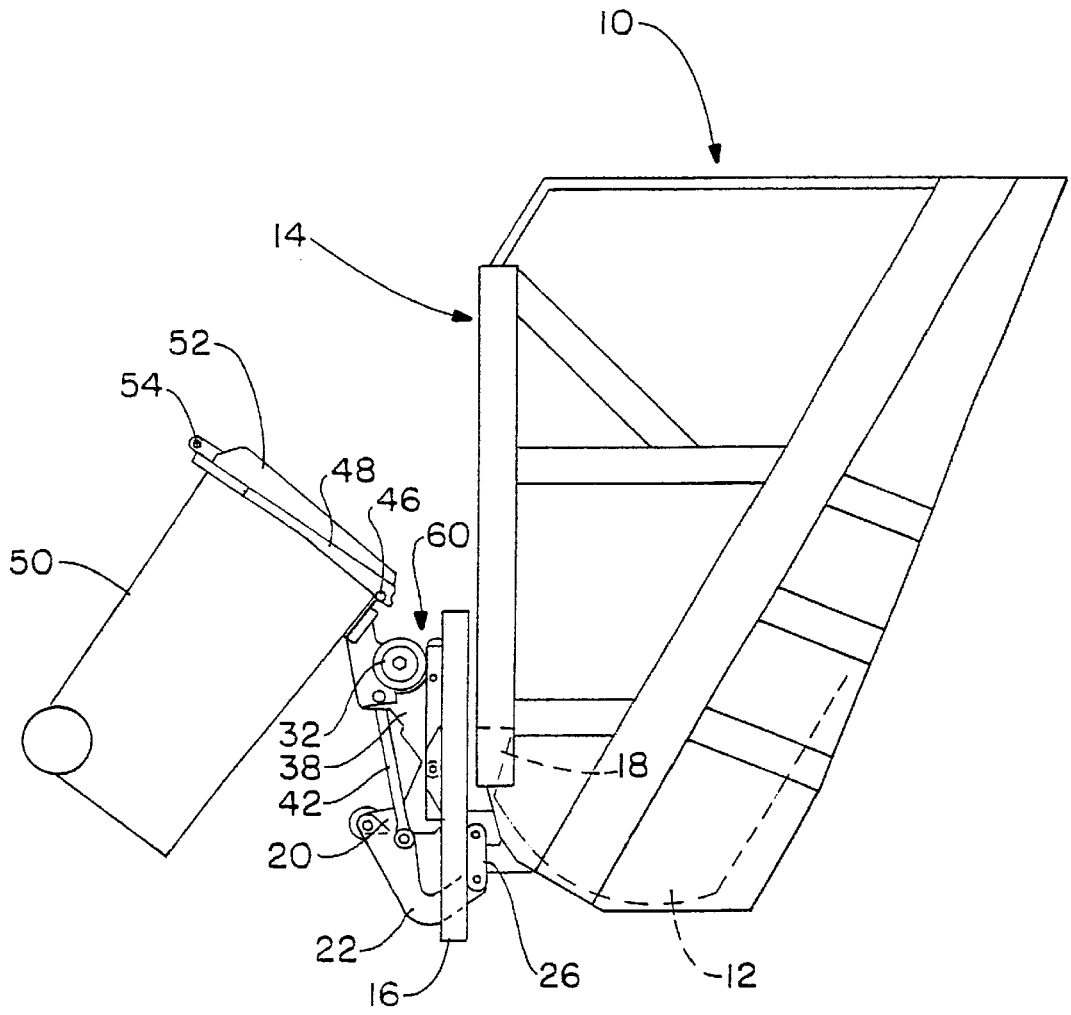
FIG. 2 is a side view of the lifting and tipping device with picked-up refuse container.

FIG. 2 depicts the same lifting and tipping device 5 in its raised position when the defined height of lift has already been reached.

Figure 3:
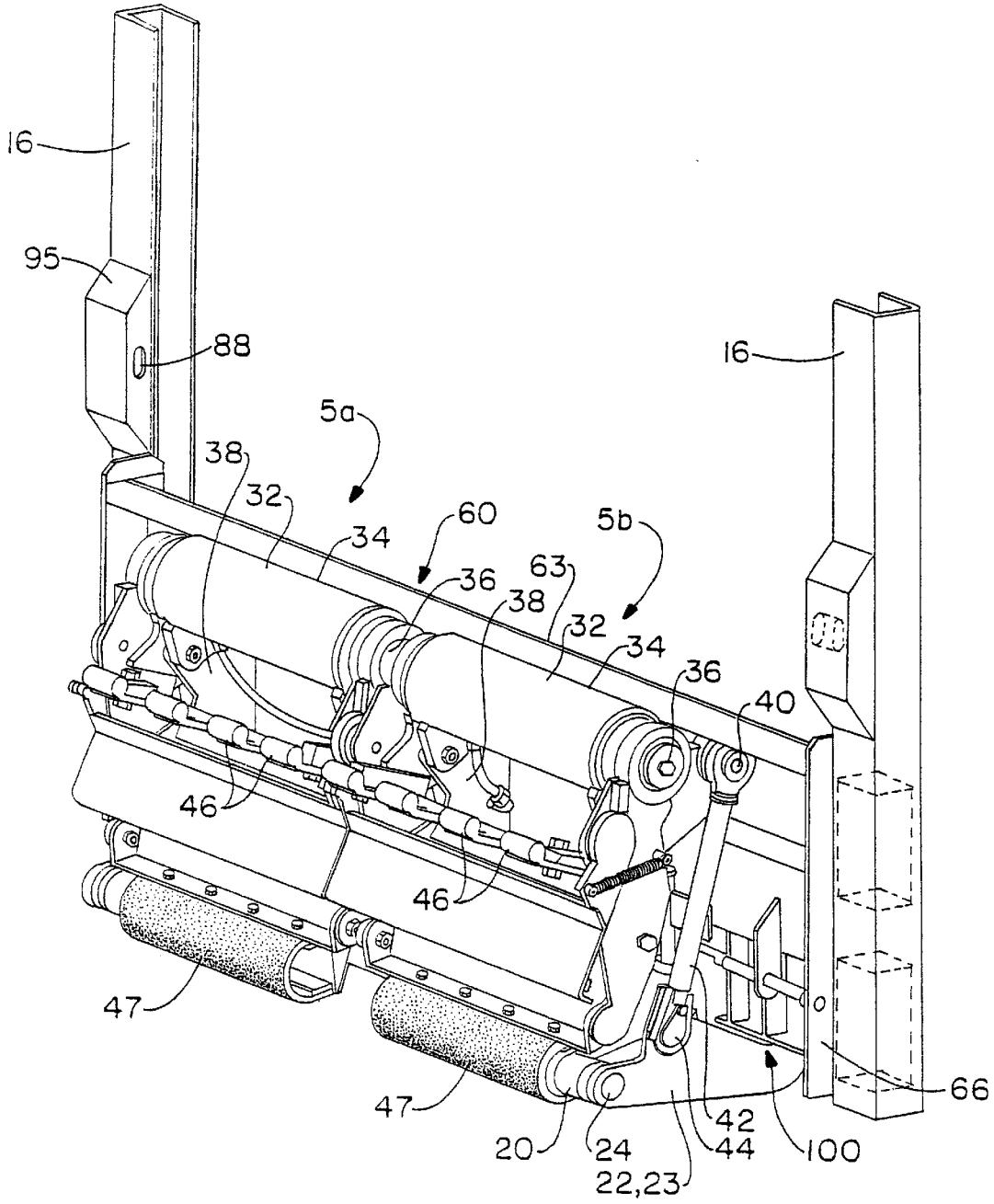
FIG. 3 is a perspective view of two side-by-side tipping devices in their lowered position, FIGS. 4+5 are side views of the tipping device in various swivel and lifting positions to illustrate the motion sequence.

FIG. 3 shows two side-by-side lifting and tipping devices 5*a,* 5*b.* At the lateral edge of the loading opening 14, two vertical rails 16 are arranged in which the slide 60 is guided so as to be vertically displaceable. On this common slide 60, two swivel drive units 32 are coaxially arranged side by side. Each swivel drive device 32 has a housing 34 and a swivel shaft 36, on each of which is arranged a swivel arm 38 with container receiving device 46. On each swivel drive device 32 or swivel arm 38 a connecting rod 42 is coupled at point 40. In the lower area of each of the lifting and tipping devices 5*a,b* the supporting levers 22 are provided in the form of angle levers 23, which are coupled behind the rear wall 63 of the slide 60 to the truck 10 or the collecting container 12 (not shown). At the front end, the arm of the angle lever 23 widens so that two coupling points 24 and 44 can be provided. The connecting rod 42 is coupled at coupling point 44 and the angle lever 23 is coupled to the holding element 20 at coupling point 24. The holding element in addition carries the support element 47 against which the container wall rests during the emptying process. The holding element 20 is a plate that is fixed to the rear wall 63 of the slide 60. The rotary axes passing through the coupling points 40, 44, 24 lie parallel to the rotary axis of the two swivel shafts 36. The slide 60, adjacent to the respective rail 16, has a vertically oriented plate 66 behind which a locking mechanism 100 is arranged, which will be explained in greater detail in connection with FIGS. 6 to 9.

Figure 4:
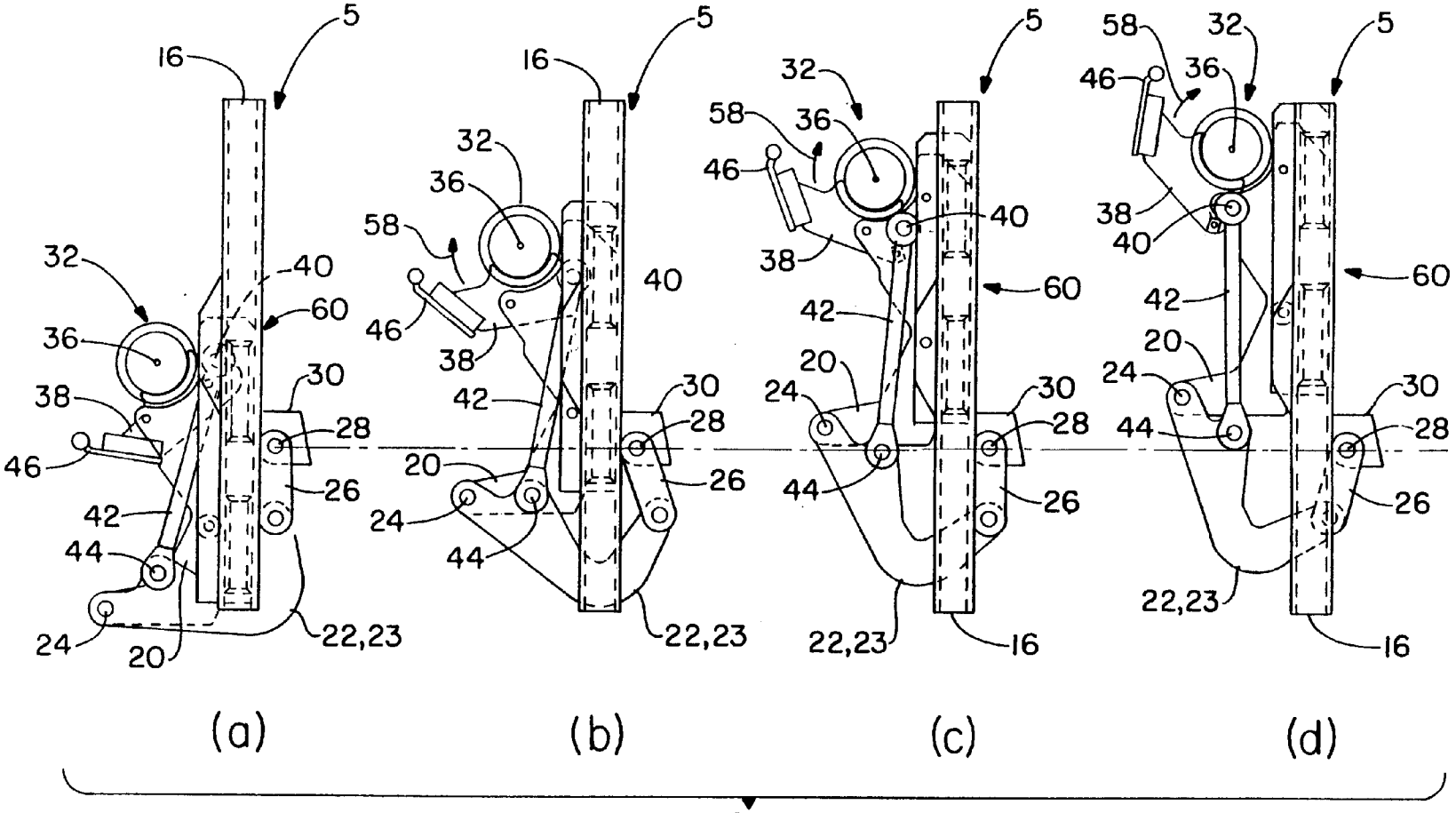
Figure 5:
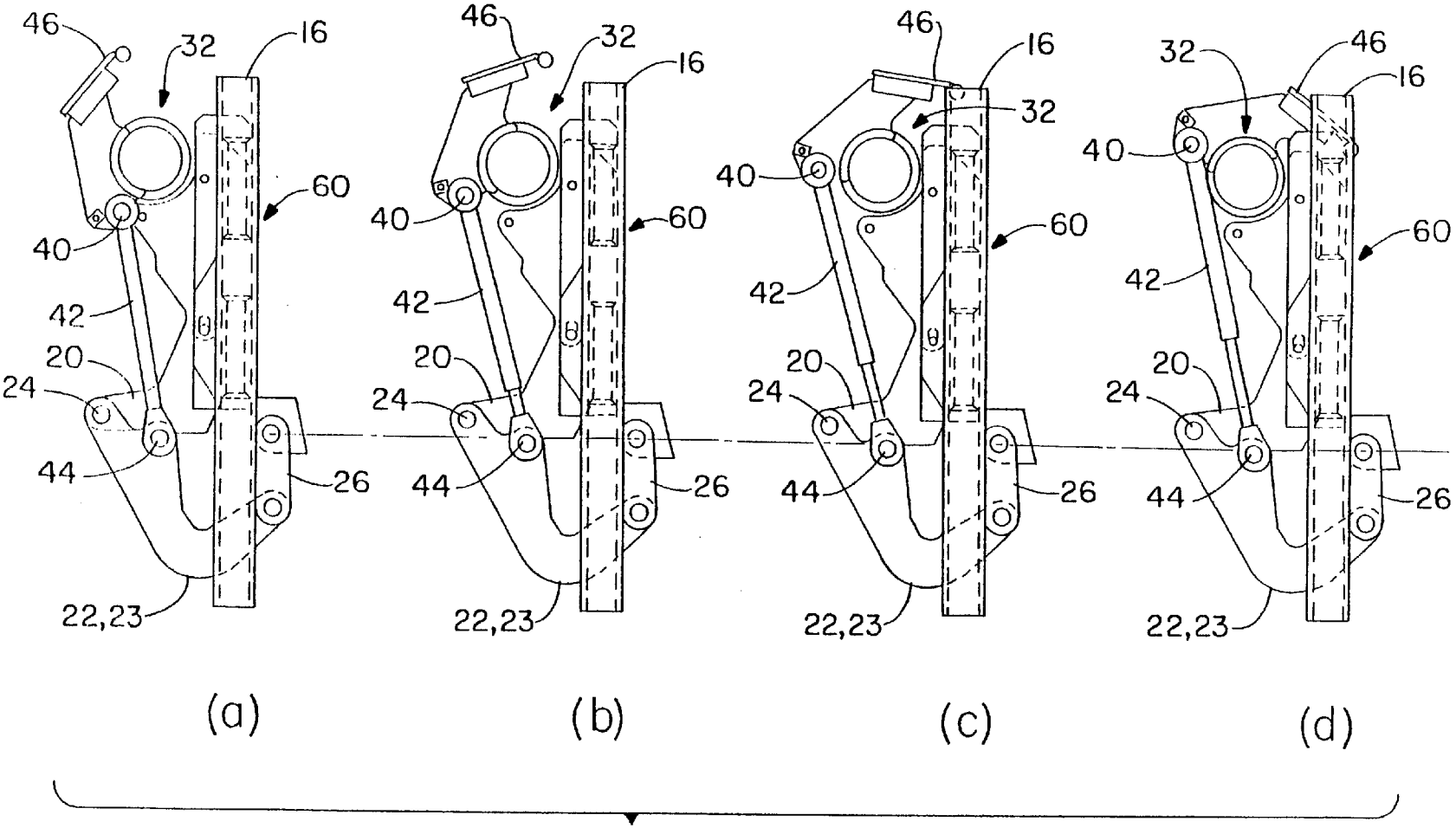

FIGS. 4 and 5 show the lifting and tipping device 5 in a side view to illustrate the different motion positions. The swivel arm 38 is short, so that the container receiving device 46 is arranged closely to the swivel drive device 32 to create an overall compact lifting and tipping device 5. FIG. 4*a* shows the lifting and tipping device 5 in its lowered position, with the container receiving device 46 swung down. It may be clearly seen that in this position the coupling point 40 of the connecting rod 42 is at the same height as the swivel axis of the swivel shaft 36 of the swivel drive device 32.

The lower coupling point 44 of the connecting rod 42 is about vertically below the swivel shaft 36. This figure also shows that the angle lever 23 is flexibly coupled at coupling point 28 with plate 30, which is mounted to truck 10 via a link element 26.

The holding element 20 has a substantially L-shaped form. The free end of the short arm extending rearward has a coupling point 24 of angle lever 23.

After the swivel drive device 32 is set into motion, the swivel arm 38 is swiveled in clockwise direction 58. Due to the eccentric arrangement of the connecting rod 42, the connecting rod is pushed downward, while the angle lever 23 swings slightly toward the rear and the slide 60 is thereby simultaneously moved upward together with the swivel drive device 32.

As may be seen from FIG. 4*c* and 4*d,* this movement continues until the connecting rod 42 is vertically aligned and the coupling point 44 is vertically below the swivel shaft 36. The angle lever 23 is increasingly rotated in direction 58. In this position the container 50 has already been picked up and the slide 60 is just before reaching the defined height of lift.

In FIG. 5*a,* the defined height of lift has been reached and locking with the rail 16, which will be further explained below, is complete. In FIG. 5*b,* the swivel movement of the swivel drive device 32 continues, which causes the container to be tipped into the loading opening 14. Due to the lock, the lower coupling point 44 of the connecting rod 42 remains stationary so that the connecting rod, which is designed as a telescoping rod, is extended. This movement continues, until the final tipping position is reached as shown in FIG. 5*d.* At this moment, the connecting rod 42 is completely extended. Due to the restoring force within the connecting rod 42, the swivel drive device 32 is retracted again after reaching the tipping position and the setting down process begins.

Figure 6:
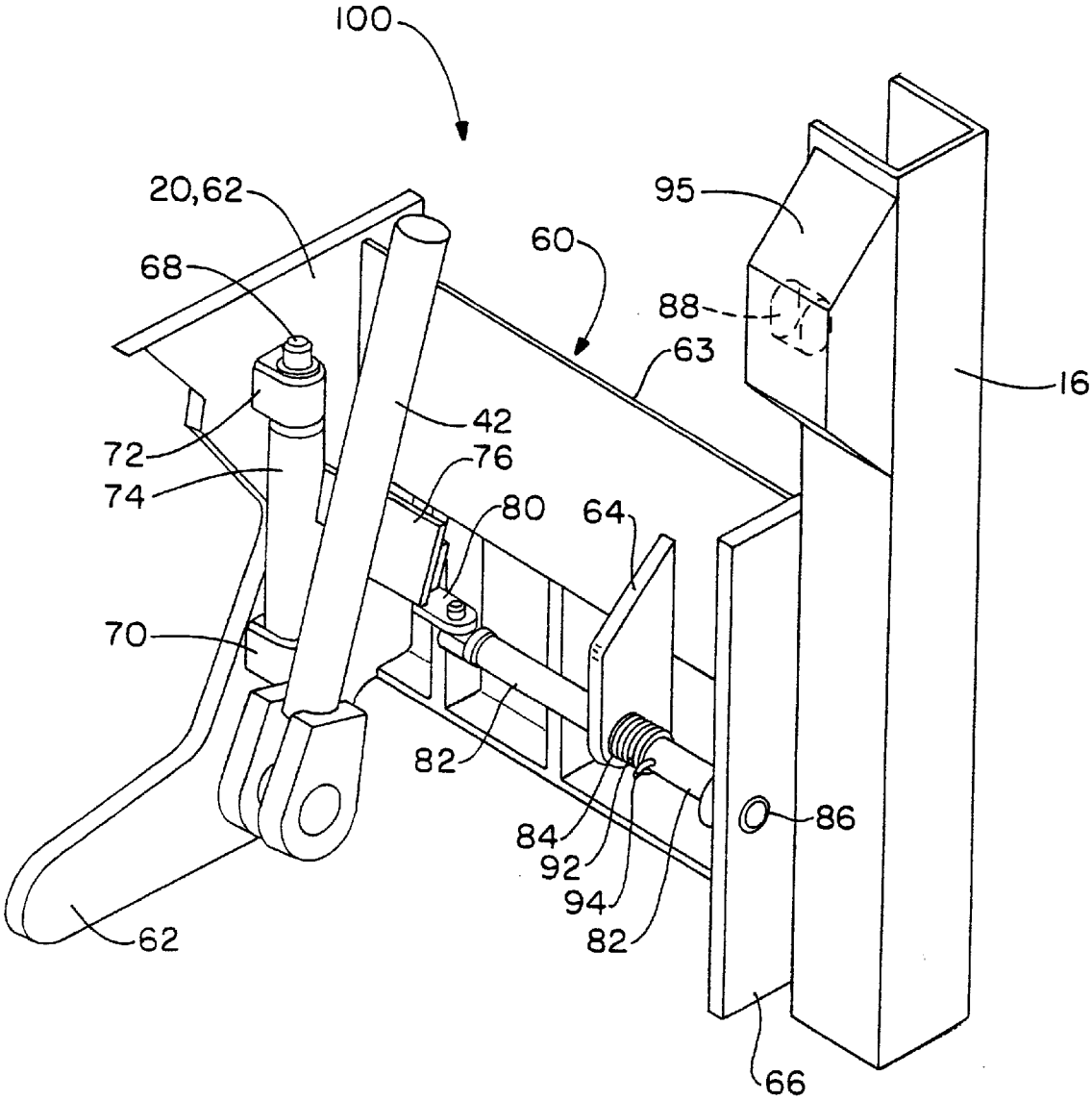
FIG. 6 is a perspective view of the locking mechanism of the lock.
Figure 7:
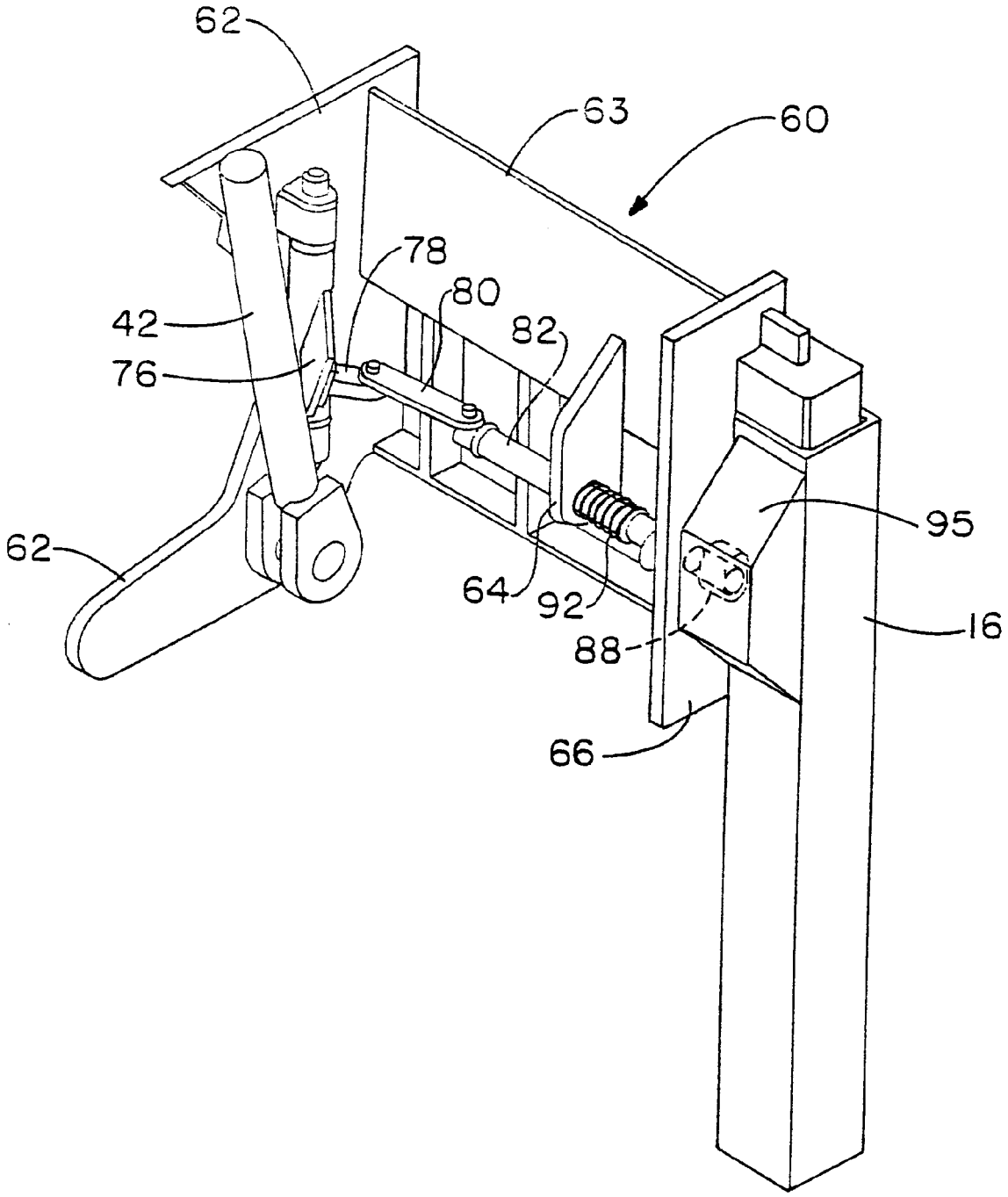
FIG. 7 is a perspective view of the locking mechanism in its locked state, and FIGS. 8+9 are top views of the locking mechanism according to FIGS. 6 and 7.

FIG. 6 is a magnified representation of the locking mechanism 100. The left part of FIG. 6 shows the holding element 20 in the form of a plate 62 to which only the connecting rod 42 is coupled while the angle lever 23 has been omitted for the sake of clarity. A bolt 68 held by two bearing blocks 72 and 70 is arranged in vertical direction on holding element 20. Between the bearing blocks 70, 72 there is a rotatable tubular section 74 on which a vane 76 is disposed. Furthermore, a swivel lever 78 connected with a locking bolt 82 via a connecting lever 80 is arranged on this tubular section 74 (as shown in FIG. 7). Bolt 82 is supported in the bearing openings 84, 86 of plates 64, 66 so that it is horizontally displaceable. The position shown in FIG. 6 is brought about by the reset spring 92, which is fixed by pin 94. During the swivel movement of the swivel drive device 32, the alignment of the connecting rod 42 is continuously changed, and when the defined height of lift is reached, the connecting rod 42 presses against vane 46 causing bolt 82 to be pushed. This is shown in FIG. 7, where a bolt plate 95 with an oblong hole 88 is arranged on rail 16, so that the bolt 82 can engage therewith to lock the slide 60 in relation to the rail 16.

Figure 8:
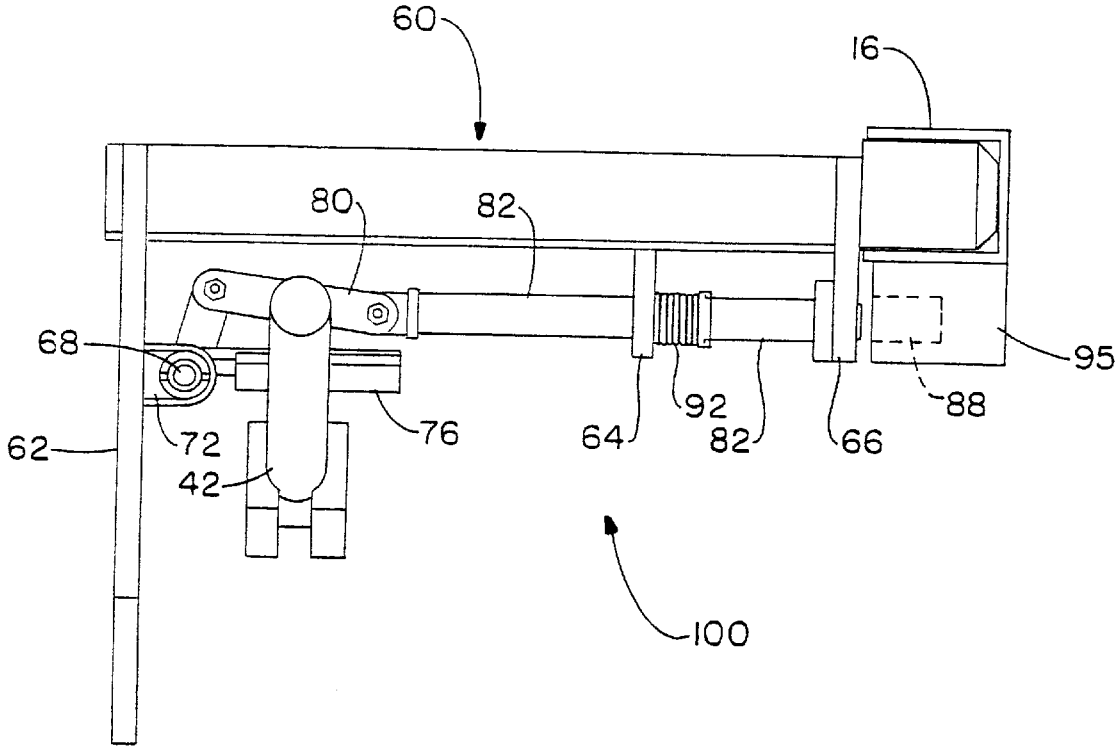
Figure 9:
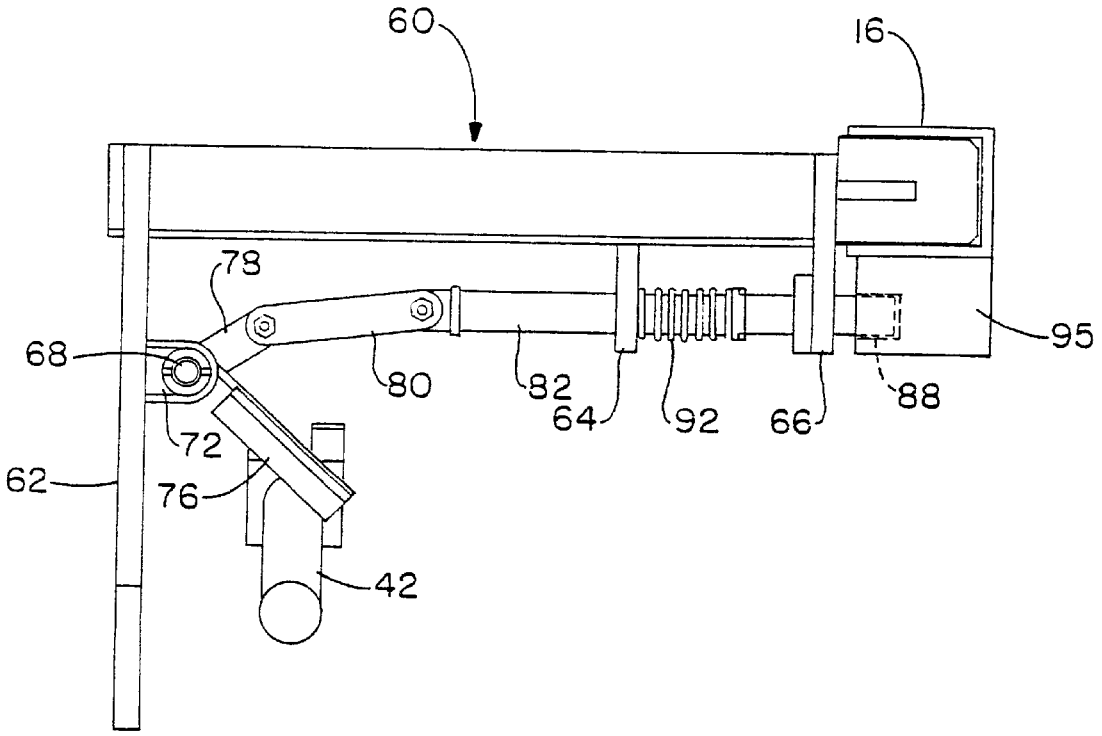

FIGS. 8 and 9 are top views of the arrangements shown in FIGS. 6 and 7.

REFERENCE NUMBERS

5, 5*a* 5*b* lifting and tipping device
10 refuse truck
12 collecting container
14 loading opening
16 rail
18 cross strut
20 holding element
22 support lever
23 angle lever
24 coupling point of angle lever on holding element
26 link element
28 coupling point of link element
30 plate
32 swivel drive device
34 housing of swivel drive device
36 swivel shaft
38 swivel arm
40 coupling point of connecting rod
42 telescopic connecting rod
44 coupling point of connecting rod on support lever
46 container receiving device
47 support element
48 receiving rim of refuse container
50 refuse container
52 lid of refuse container
54 swivel axis of lid
56 swivel direction of angle lever
58 swivel direction of swivel arm
60 slide
62 plate
63 rear wall
64 side plate
66 side plate
68 pin
70 bearing block
72 bearing block
74 tubular section
76 vane
78 swivel lever
80 connecting lever
82 locking bolt
84 bearing opening
86 bearing opening
88 oblong hole
92 spring
94 pin
95 bolt plate
100 locking mechanism

What is claimed is:

1. A lifting and tipping device for emptying containers into a loading opening of a collecting container of a refuse truck, comprising:

a swivel drive device adapted to be connected to said truck in an area of the loading opening, to which at least one swivel arm with a container receiving device is operatively connected, wherein the swivel drive device is fixed to a slide guided in at least one vertical rail, wherein a means operatively connected to the swivel arm is provided which transforms a rotation of the swivel drive device, during a simultaneous swivel movement of the swivel drive device by the swivel arm, into a lifting movement of the slide which stops at a defined height of lift, wherein the slide is locked by a locking mechanism in relation to the rail at the defined height of lift, and wherein after locking of the slide, the swivel movement of the swivel drive device is continued to tip the container.

2. A device as claimed in claim 1, wherein said means comprises a support lever and a connecting rod, wherein said connecting rod is coupled eccentrically to the swivel drive device and to the support lever, which in turn is coupled with the slide as well as directly or indirectly with the collecting container.

3. A device as claimed in claim 2, wherein the support lever is an angle lever that extends underneath the slide in the direction of the collecting container.

4. A device as claimed in claim 3, wherein the angle lever is connected via a link element with the collecting container.

5. A device as claimed in claim 4, wherein the support lever and the connecting rod have rotary axes, which pass through coupling points, and are arranged parallel to a swivel axis of the swivel drive device.

6. A device as claimed in claim 5, wherein the support lever is coupled with a holding element which is fixed to the slide and extends underneath the swivel drive device from the slide to in front of the swivel drive device.

7. A device as claimed in claim 6, wherein the coupling point of the connecting rod is located on the angle lever between the coupling point of the angle lever with the holding element and the slide.

8. A device as claimed in claim 2, wherein the connecting rod is arranged on the swivel drive device in such a way that it moves downward in relation to the swivel drive device as the container receiving device swivels.

9. A device as claimed in claim 2, wherein a locking mechanism is arranged on the slide which can be actuated by the connecting rod.

10. A device as claimed in claim 9, wherein the locking mechanism has a spring-loaded bolt that engages with an opening of a bolt plate arranged on the rail at the defined height of lift.

11. A device as claimed in claim 2, wherein the connecting rod is telescopic.

* * * * *